US008360608B2

(12) United States Patent
Wildner

(10) Patent No.: US 8,360,608 B2
(45) Date of Patent: Jan. 29, 2013

(54) ILLUMINATING SYSTEM OF FLEXIBLE SHAPE

(75) Inventor: Florian Wildner, Munich (DE)

(73) Assignee: Osram AG, Munich (DE)

( * ) Notice: Subject to any disclaimer, the term of this patent is extended or adjusted under 35 U.S.C. 154(b) by 925 days.

(21) Appl. No.: 12/306,966

(22) PCT Filed: Jun. 27, 2007

(86) PCT No.: PCT/DE2007/001139

§ 371 (c)(1),
(2), (4) Date: May 19, 2009

(87) PCT Pub. No.: WO2008/003289

PCT Pub. Date: Jan. 10, 2008

(65) Prior Publication Data

US 2012/0182755 A1 Jul. 19, 2012

(30) Foreign Application Priority Data

Jul. 6, 2006 (DE) ..... 10 2006 031 345

(51) Int. Cl.
*F21V 21/00* (2006.01)

(52) U.S. Cl. ..... 362/249.04; 362/237; 362/249.08; 362/249.11

(58) Field of Classification Search ..... 362/237, 362/246, 249.02, 249.03, 249.04, 249.07, 362/249.08, 249.11, 255, 256, 318, 294, 362/555

See application file for complete search history.

(56) References Cited

U.S. PATENT DOCUMENTS

| | | | | |
|---|---|---|---|---|
| 5,404,869 | A | 4/1995 | Parkyn, Jr. et al. | |
| 5,890,794 | A * | 4/1999 | Abtahi et al. | 362/294 |
| 6,074,074 | A | 6/2000 | Marcus | |
| 6,299,337 | B1 | 10/2001 | Bachl et al. | |
| 6,851,832 | B2 * | 2/2005 | Tieszen | 362/249.03 |
| 6,891,200 | B2 * | 5/2005 | Nagai et al. | 362/249.04 |
| 7,604,376 | B2 * | 10/2009 | Sloan et al. | 362/246 |
| 2003/0072153 | A1 | 4/2003 | Matsui et al. | |
| 2003/0147253 | A1 | 8/2003 | Shy | |

FOREIGN PATENT DOCUMENTS

| | | |
|---|---|---|
| CN | 1563785 | 1/2005 |
| CN | 2677740 | 2/2005 |
| DE | 196 21 148 | 12/1997 |
| DE | 196 27 856 | 1/1998 |
| DE | 103 32 771 | 3/2005 |
| EP | 1 033 525 | 9/2000 |
| WO | WO 90/02906 | 3/1990 |
| WO | WO 01/98708 | 12/2001 |
| WO | WO 2004/070262 | 8/2004 |

OTHER PUBLICATIONS

State Intellectual Property Office, P.R. China, "First Office Action", Appl. No. 200780031187.X, issued on May 4, 2010 (4 pages).

(Continued)

*Primary Examiner* — Y My Quach Lee
(74) *Attorney, Agent, or Firm* — Fish & Richardson P.C.

(57) ABSTRACT

Disclosed is an illuminating system of flexible shape and comprising at least one LED disposed on a flexible carrier material, an optic being provided that permits uniform, directed and/or glare-free light emission.

32 Claims, 9 Drawing Sheets

OTHER PUBLICATIONS

Notification of Transmittal of Translation of the International Preliminary Report on Patentability issued in corresponding International Application No. PCT/DE2007/001139 on Jan. 29, 2009.

State Intellectual Property Office, P.R. China, "First Office Action", Appl. No. 100780031187, issued on May 4, 2010 (4 pages).

The International Search Report for PCT/DE2007/001139, dated Sep. 21, 2007.

* cited by examiner

ILLUMINATING SYSTEM OF FLEXIBLE SHAPE

CROSS-REFERENCE TO RELATED APPLICATION

This application is the National Stage International Application No. PCT/DE2007/001139, filed on Jun. 27, 2007, which claims priority to German Patent Application Serial No. 10 2006 031 345.3, filed on Jul. 6, 2006. The contents of these applications are hereby incorporated by reference in their entireties.

TECHNICAL FIELD

The present application is directed to an illuminating system of flexible shape and comprising at least one light-emitting diode (LED) disposed on a flexible carrier material.

BACKGROUND

Illuminating systems exist in which a multiplicity of LEDs are disposed one after the other in a flexible plastic tube of approximately rectangular cross section. A disadvantage of such light tubes is that the light action that can be obtained with them is limited to punctiform emission from the LEDs, so the LEDs are discernible as individual points of light and an undesirable glare effect may occur.

SUMMARY

It is an object to create an illuminating system which, compared to conventional solutions, permits glare-free illumination combined with flexible construction and compact dimensions.

An illuminating system of flexible shape comprising at least one LED is specified. The LED is disposed on a flexible carrier material, an optic being provided that permits uniform, directed and/or glare-free light emission.

Compared to the prior art, the illuminating system is of flexible shape, i.e., bendable, and by virtue of the optic emits directed light with no glare effect, while at the same time, individual points of light are substantially undiscernible. The illuminating system additionally features high integration of the LEDs and variability in terms of its lighting capabilities. In particular, drops in emitted radiation intensity between adjacent LEDs are eliminated or at least greatly reduced. In other words, the individual points of light represented by the LEDs are converted into a glare-free light line or light area. Radiation is able to emerge particularly uniformly along this light line or from this light area. Novel light-emitting devices are thereby obtained that are suitable not only for illumination, but also for display, for example of information on monitors, traffic signs or advertising spaces, or for highlighting (backlighting). Its very small dimensions also make the illuminating system a natural choice for recessed lighting. Due to its flexibility, the illuminating system can be used on curved surfaces or can be deformed in open space through the addition of suitable mechanisms or motion devices (rods, ropes, tires, etc.).

It is especially advantageous under these circumstances if the optic is configured as a separate component, particularly one that is separate from the LED. In particular, the separate optic can be distinct from an encapsulant for a semiconductor chip of the LED. By virtue of the replaceable optics, the illuminating system can be variably adapted to different lighting and illumination tasks by changing said optics.

Several preferred embodiments of the optics are feasible, and can advantageously be combined with one another. For example, the collimation, guidance and equalization of the light is effected by means of a lens and/or an optically active medium (film, glass, fluid, etc.), which can be mounted spacedly or non-spacedly with respect to the LED. Thus, the optic can be embodied, for example, by a lens optic, particularly by Fresnel lenses. Fresnel lenses are distinguished in particular by their flat construction. This facilitates the design of an illuminating system with a very small overall height.

In a preferred embodiment, the overall height of the illuminating system is 10 mm or less, particularly 5 mm or less. The overall height can also be reduced further, and can be 4 mm or less, preferably 3 mm or less, particularly preferably 2 mm or less, for example 1.5 mm or less.

The lens optic can also be made of a rigid material, such as glass, for example. Also advantageous, however, are other exemplary embodiments in which the optic is formed by a nano- or microstructured film or by macrostructures in the film, such as convexities, corrugations or knobs. The film variant notably has the advantage of enabling the overall size of the illuminating system to be kept particularly small, while at the same time permitting high flexibility, especially mechanical flexibility. Rigid components (LEDs, lenses, etc.) can be incorporated by giving them a suitable structural shape and linking them together in a quasi-flexible arrangement ("chain line").

In a preferred embodiment, a microstructured film has in a lateral direction, i.e., along a main direction of extension of the film, a structure having structure sizes of 500 μm or less, preferably 100 μm or less, particularly preferably 10 μm or less. The radiation emitted by the at least one LED during the operation of the illuminating system can thus be shaped in a simple and reproducible manner.

In a preferred embodiment, a nanostructured film has in a lateral direction a structure having structure sizes of 1000 nm or less. Further preferably, the structure size can be in the range of the emission wavelength of the associated LED in the material of the film, particularly between 0.2 times and five times the emission wavelength in the material of the film. Such a film makes it possible to influence the radiation characteristic of the illuminating system, for example by diffraction effects, and adapt it to a predetermined radiation characteristic of the illuminating system.

Such a particularly microstructured or nanostructured film can be regularly structured, particularly periodically and recurrently in one or more spatial directions, or it can be irregularly structured.

A fluid can also be used, however, in which case uniform, directed and glare-free light action is obtained as a result of the refractive index differential between air and fluid. The use of fluids is advantageous particularly in achieving broad flexibility.

The use of rigid materials can also be advantageous, however. Particularly in cases where the optic is implemented as a lens system, glass lenses or lenses made of similar materials are advantageous due to their ease of fabrication. In this case, the flexibility is preferably furnished by having the rigid optic consist of a plurality of individual parts whose position in relation to the LEDs nevertheless remains unchanged, even, notably, on deformation of the illuminating system.

Preferred exemplary embodiments of the illuminating system can further comprise a holder for the optic and/or at least one lamp envelope, particularly a tube, a (deep-drawn) film or a molded part, the holder and the envelope being so configured as not to present an obstacle to deformation of the illuminating system.

In a preferred improvement, the lamp envelope is formed by at least one element from the group consisting of molded part, tube, film and deep-drawn film.

In a preferred embodiment, the holder comprises at least two support elements, which are preferably disposed diametrically opposite each other. The optic is supported on the carrier material by means of these elements.

It has been found to be particularly advantageous if the optic is mounted in such a way that its position in relation to the LED remains substantially unchanged during deformation of the illuminating system.

The illuminating system preferably employs flat LEDs, particularly DRAGON®, TOPLED®, PointLED® and/or SIDELED® type LEDs, which give the illuminating system the preferred flatness. DRAGON type LEDs manufactured by Osram Opto Semiconductors GmbH are characterized in particular by high radiant power at an electric power consumption of 100 mW or more. These are consequently high-power LEDs. TOPLED type LEDs manufactured by Osram Opto Semiconductors GmbH notably have a preferred direction of emission that is perpendicular or substantially perpendicular to a mounting plane of the LED. In the case of a SIDELED type LED manufactured by Osram Opto Semiconductors GmbH, emission by the LED preferentially occurs primarily along the mounting plane. PointLED type LEDs manufactured by Osram Opto Semiconductors GmbH are notable in particular for their compact construction. The radiation characteristic of these LEDs is comparable to that of a punctiform light source.

Further preferably, the LEDs of the illuminating system are implemented as surface-mountable components. Surface-mountable components are also known as SMD components (SMD=Surface Mountable Device). Such components are easier to mount.

It is generally advantageous if the LEDs are implemented as colored and/or color-changing. Such LEDs make it possible to emit radiation that produces a colored, for instance red, blue, green or mixed-color, impression to the human eye. In particular, the LEDs can comprise plural, for instance three, LED chips that emit radiation in mutually different regions of the spectrum, for instance in the green, blue and red spectral regions. The illuminating system can further be equipped with a combination of different LEDs, for example ones that differ as to spectral characteristic.

In a preferred variant embodiment, the carrier material used is a film conductor and/or a flexboard, thus yielding a flexible illuminating system with an extremely small overall height. It is further advantageous to mount the LEDs on the carrier material directly, i.e., without a housing (COF: Chip on Flexboard). The overall size can be further minimized, according to another variant embodiment, through the use of height-optimized, particularly active or passive electronic, components, for example height-minimized resistors and/or drivers, particularly film resistors, hybrid resistors or the like.

To improve heat dissipation from the LEDs, preferably at least one thin cooling element, particularly a cooling plate, of high thermal conductivity is provided. The dissipation of heat can further be improved by filling the lamp envelope or the molded part with a high thermal conductivity material (metal, filled plastic, ceramic platelets, etc.). In the case of LEDs having a high power density, the dissipation of heat by the integrated cooling plate preferably takes place directly on an external heat sink, i.e., without an insulating plastic lamp housing. In this case, the external, for example rigid, heat sink can also be only partially formed and magnetically attached to the cooling plate. In particular, the heat sink can be formed from flexible corrugated sheet metal and attached directly to the plate, thus bringing about functional unification with regard to the tasks of holding and cooling by the cooling plate. Through this optimization of thermal management, the light output of the illuminating system can be improved further without altering its reduced installation space.

The flat and flexible implementation makes it possible to configure the illuminating system as a flexible, flat light strip. To this end, it is particularly preferred if a lamp housing is configured as a hollow profile bar of substantially rectangular cross section, in which the LEDs are adjacently disposed and form a common light-emitting area. In terms of production engineering, such a bar can advantageously be produced for example as an extruded profile made of a plastic, for example PMMA. The light strip is preferably extendible in segments (according to the arrangement of the electrical circuits) as the application requires.

In a preferred embodiment, the hollow profile bar has an interior space that is designed to receive the LEDs and is closed endwise, preferably sealingly, by an end piece or by a plug-type electrical connector system (plug or socket). It is preferred, in this case, for this element to be configured such that in the state of being mounted on the hollow profile bar, at least one lateral face extends flush with at least one lateral face of the hollow profile bar. After the light strip has been extended to suit the application, the strip can thus be closed off, preferably sealingly, by means of the end piece or the plug-type electrical connector system. The illuminating system can thus be adapted particularly easily to specific requirements within broad limits.

To mount the illuminating system, for example on a ceiling, the floor, the wall or a piece of furniture, the hollow profile bar, in a preferred exemplary embodiment, is insertable form-lockingly into a mounting profile. It is advantageous in this case if the hollow profile bar comprises at least one projection that engages in at least one guide channel of the mounting profile, or if the hollow profile bar comprises at least one guide channel in which the at least one projection of the mounting profile engages.

In an alternative exemplary embodiment, the cooling plate or the mounting surface is magnetically configured for the purpose of mounting the illuminating system.

According to a further alternative exemplary embodiment, the side walls of the mounting profile comprise at least one channel in which a roughly U-shaped, fixedly disposable holder for mounting the illuminating system form-lockingly engages.

The flat and flexible implementation further makes it possible to configure the illuminating system as a flexible, pixel-type flat lamp equipped with a multiplicity of LEDs. For example, the flat lamp can be implemented as a preferably active display, particularly for moving images. Such a flat lamp or flat display is suitable for placement on curved surfaces having potentially multiple, mutually parallel or obliquely convergent axes of curvature with different, potentially negative, bending radii.

The flat lamp can be cut into individual rectangles and the electrical connections re-established by means of a connecting element (X connector). In terms of production engineering, the manufacture of the illuminating system can easily be automated and is suitable for large-volume runs, e.g., for the production of light-emitting wallpaper, advertising spaces and large-area displays. For example, the illuminating system can include one LED for each pixel, in which case the emitted radiant power in the red, green and blue regions of the spectrum can be controlled mutually separately by means of the LEDs. Alternatively, a plurality of LEDs emitting radiation in different regions of the spectrum can be provided for each pixel. A display capable of full color reproduction can be produced in a simplified manner in this way.

The illuminating system can be freely focused by varying the curvature. An extremely broad range of emission angles can also be obtained.

According to a preferred exemplary embodiment, the LEDs are controllable individually via a control device, particularly a bus, making it possible to obtain varied light effects, for example colors of light, accents or light dynamics and optical displays, for example of still or moving images.

Further advantages, preferred embodiments and utilities of the illuminating system will emerge from the exemplary embodiments described hereinafter in conjunction with the figures. Therein:

DETAILED DESCRIPTION

Figure 1:
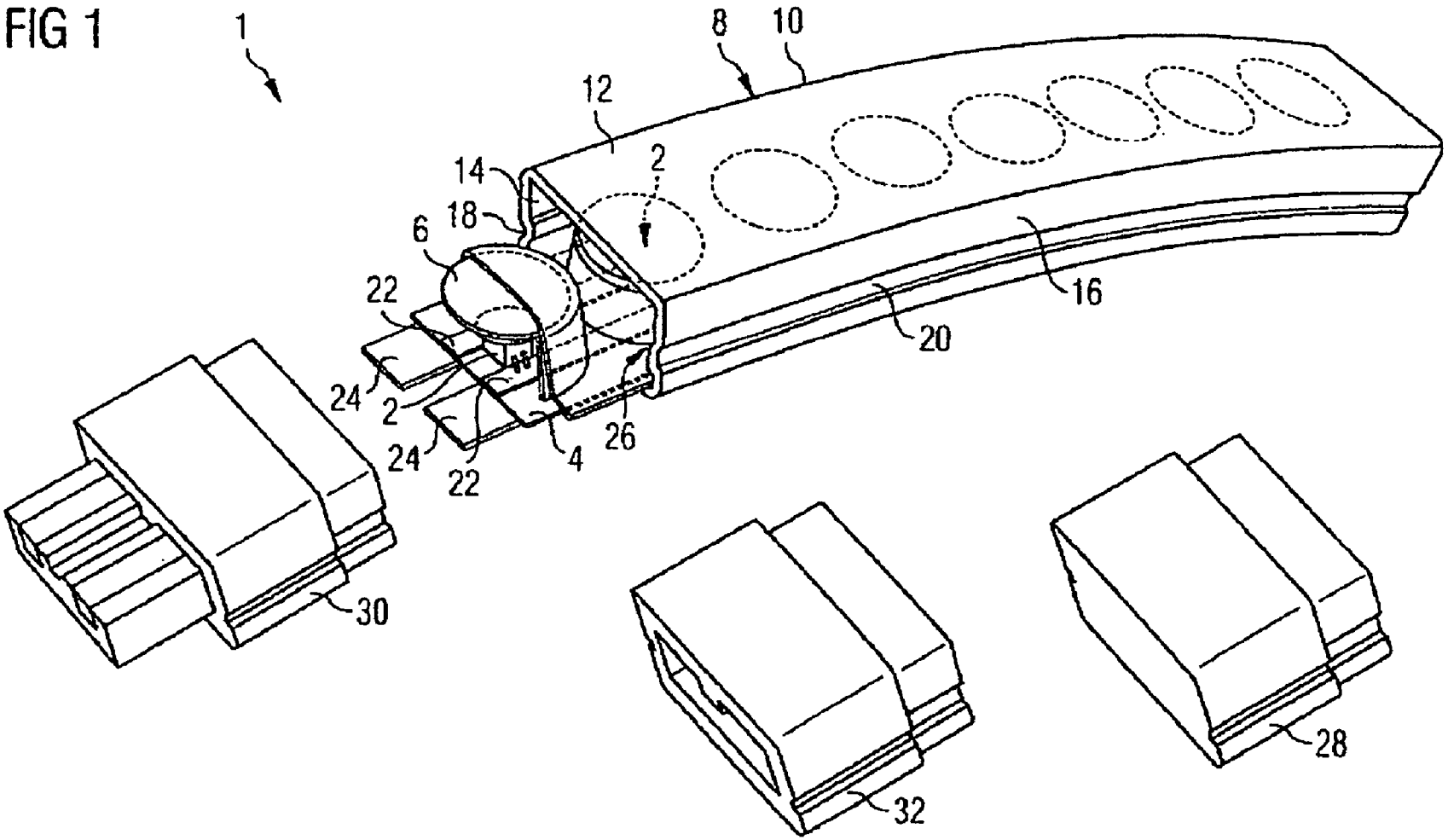
FIG. 1 is a schematic perspective representation of an illuminating system of flexible shape according to a first exemplary embodiment.

FIG. 1 is a schematic representation of an illuminating system 1 of flexible shape according to a first exemplary embodiment, comprising a multiplicity of TOPLED® type LEDs 2. The LEDs are implemented as surface-emitting components and in operation emit radiation from a side facing away from the mounting surface. The LEDs are disposed one after the other on a flexible carrier material 4, an optic 6 being provided that permits uniform, directed and/or glare-free light emission. The illuminating system 1 is configured to be of flexible shape and emits light directedly but with no glare effect, while at the same time the individual points of light constituted by the LEDs 2 are substantially undiscernible. The radiant power emitted by the illuminating system thus does not drop, or at least drops only slightly, in the region between two adjacent LEDs 2. The illuminating system 1 is further distinguished by high integration of the LEDs 2 and variability in terms of its lighting capabilities. Novel light-emitting devices are thereby obtained that are suitable not only for illumination, but also for display (e.g., of information on monitors, traffic signs, advertising spaces, etc.), and for highlighting (backlighting). Its very small dimensions also make the illuminating system 1 a natural choice for recessed lighting. Due to its flexibility, the illuminating system 1 can be used even on curved surfaces or can be deformed in open space through the addition of suitable mechanisms or motion devices (rods, ropes, tires, etc.) (not shown). The flat and flexible implementation makes it possible to configure the illuminating system 1 according to FIG. 1 as a flexible, flat light strip 8 (light bar). For this purpose, the lamp housing is configured as a flexible hollow profile bar 10 having a substantially rectangular cross section and designed to receive the LEDs 2, and in which the LEDs 2 are adjacently disposed and form a common light-emitting area 12. It is generally advantageous in this case if the LEDs 2 are configured as colored and/or color-changing. In particular, the LEDs can comprise plural, for instance three, LED chips emitting radiation in mutually different regions of the spectrum, for example in the green, blue and red spectral regions. The illuminating system 1 can further be equipped with a combination of different LEDs 2. In terms of production engineering, a light bar 8 of this kind can be produced, for example, as an extruded profile made of a flexible plastic, for example of PMMA. The light bar 8 is extendible in segments (according to the arrangement of the electrical circuits) as the application requires. To mount the illuminating system 1, for example on a ceiling, the floor, the wall or a piece of furniture, the hollow profile bar 10 is insertable form-lockingly into a mounting profile or another holder (not shown), in which case projections on the mounting profile or holder engage in two guide channels 18, 20 configured on preferably opposite lateral faces 14, 16 of the hollow profile bar 10. The carrier material 4 used for the LEDs 2 in the exemplary embodiment shown is a flexboard provided with conductive traces 22, thus resulting in a flexible illuminating system 1 with an extremely small overall height of about 6 mm. To improve the dissipation of heat from the LEDs 2, two thin cooling plates 24 of high thermal conductivity are provided on the underside of the flexboard 4. Deviating from the illustrated first exemplary embodiment, the mounting can be done on magnetizable surfaces, by means of cooling plates 24 configured as magnets or through the use of a magnetic subsurface.

In the illustrated first exemplary embodiment, hollow profile bar 10 has an interior space 26 for receiving the LEDs 2, which is closeable at both ends by an end piece 28 and/or a plug-in electrical contact 30, 32 (plug 30 or socket 32). By means of plug-in contacts 30, 32, the illuminating system 1 can be expanded in a simple manner into a light bar of any desired length. The length of the illuminating system 1 thus can be adjusted in a simple and variable manner by stringing together and electrically connecting a plurality of hollow profile bars 10 by means of the plug-in contacts. The end piece 28 or the plug-in contacts 30, 32 are then configured such that in the state of being mounted on said hollow profile bar 10, their lateral faces extend flush with its lateral faces. The end piece 28 and/or the plug-in contacts 30, 32 are inserted in the bar 8 from either end and are releasably held therein for example by means of a latch connection (not shown).

Figure 2:
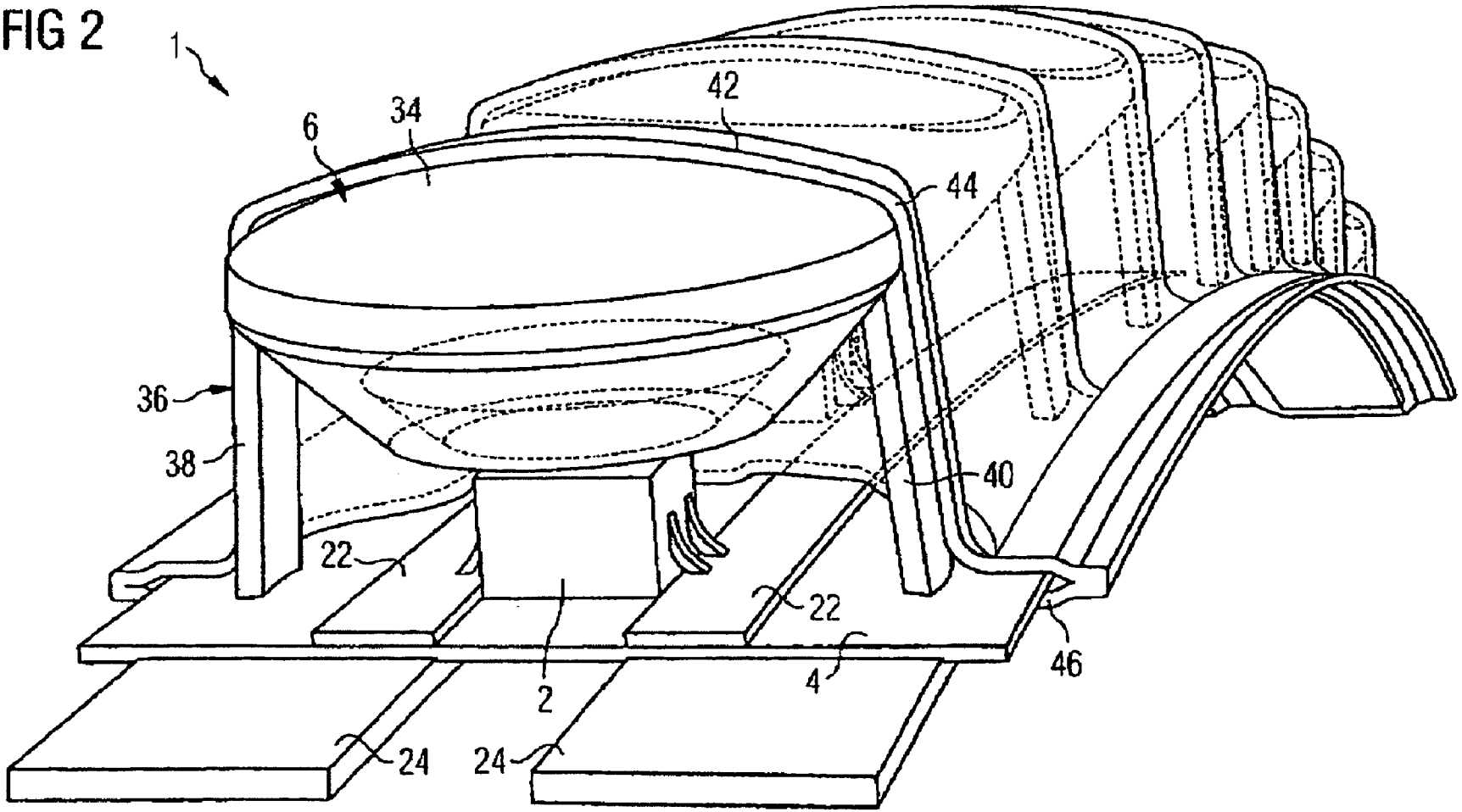
FIG. 2 is a schematic perspective representation of the illuminating system according to the first exemplary embodiment (FIG. 1) without the hollow profile bar.

Turning now to FIG. 2, which is a detail representation of the illuminating system 1 from FIG. 1 without hollow profile bar 10, the optic 6 in this exemplary embodiment is formed by a lens optic 34 made of glass or plastic and placed on top of each LED 2. It is particularly advantageous in this case if said lens optic 34 is configured as a separate component, so the illuminating system 1 can be variably adapted to different lighting and illumination tasks by changing the optics 34. The flexibility is provided in this case by the fact that the rigid optic 6 is made up of a plurality of individual parts whose position in relation to the LEDs 2 nevertheless remains substantially unchanged during deformation of the illuminating system 1. For this purpose, the lenses 32 are supported on the flexboard 4 by respective holders 36 each comprising two diametrically oppositely disposed support elements 38, 40, and are fixed on the LED 2 by means of a lamp envelope 42 made of sealed films 44, 46 that are laminated together and form-lockingly surround the lens, the holder 36 and the lamp envelope 42 being so configured as not to present an obstacle to deformation of the illuminating system 1. The illuminating system 1 can be freely oriented and focused by varying the curvature. In addition to or instead of the lenses 32, an optically active fluid can be used, in which case uniform, directed and/or glare-free light action is obtained as a result of the refractive index differential between air and fluid. The use of fluids is advantageous particularly in achieving broad flexibility. The hollow profile bar 10 (see FIG. 1) and the lamp envelope 42 serve to protect the LEDs 2 and other electronic components against environmental influences (water, dust, radiation, chemicals, and to some extent also the action of external forces) (Protection Class IP65). In this case, the cooling plates 24 are also fixed in the lamp envelope 42. The plug connector system 30, 32 (see FIG. 1) preferably also conforms to Protection Class IP65. An illuminating system implemented in this manner can also be used out of doors.

Figure 3:
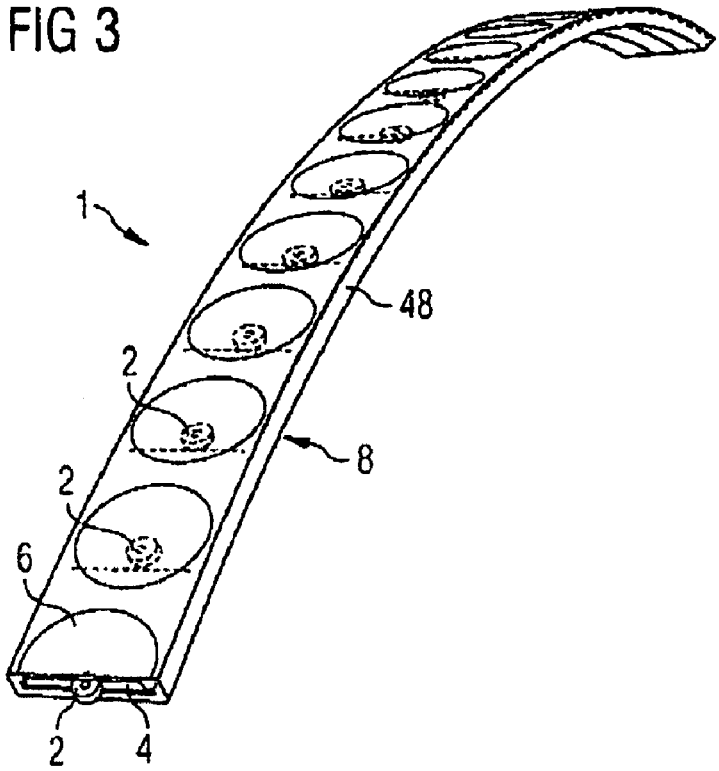
FIG. 3 is a schematic perspective representation of an illuminating system of flexible shape according to a second exemplary embodiment, comprising a flexboard and a housing of deep-drawn laminated film.

FIG. 3 shows a second exemplary embodiment of an illuminating system, in which the light bar 8 is implemented as further height-optimized. The overall height is preferably 5 mm or less, particularly preferably 4 mm or less, for example approximately 3 mm. This variant employs height-minimized POINTLED® type LEDs 2, which are disposed on a flexboard 4 and are embedded in a housing 48 of deep-drawn laminated film. This solution is distinguished in particular by an optic 6 that is integrated into the film housing 48 in the form of a micro- and/or macrostructure, thus rendering additional lens systems unnecessary. The microstructured film preferably has a structure with structure sizes of 500 μm or less, preferably 100 μm or less, particularly preferably 10 μm or less.

It is also possible to use a nanostructured film, particularly with structure sizes of 1000 nm or less. The structure size can, in particular, be in the range of preferably between 0.2 times and five times the emission wavelength of the associated LED in the material of the film. In this way, the radiation characteristic can be adjusted for example by means of diffraction effects.

Such structuring of the film can be regularly configured, particularly periodically and recurrently in one or more spatial directions, or it can be irregularly configured.

Further minimization of overall size is achieved through the use of height-optimized, particularly passive or active electronic, components, especially height-minimized resistors and/or drivers, particularly film resistors, hybrid resistors or the like.

Figure 4:
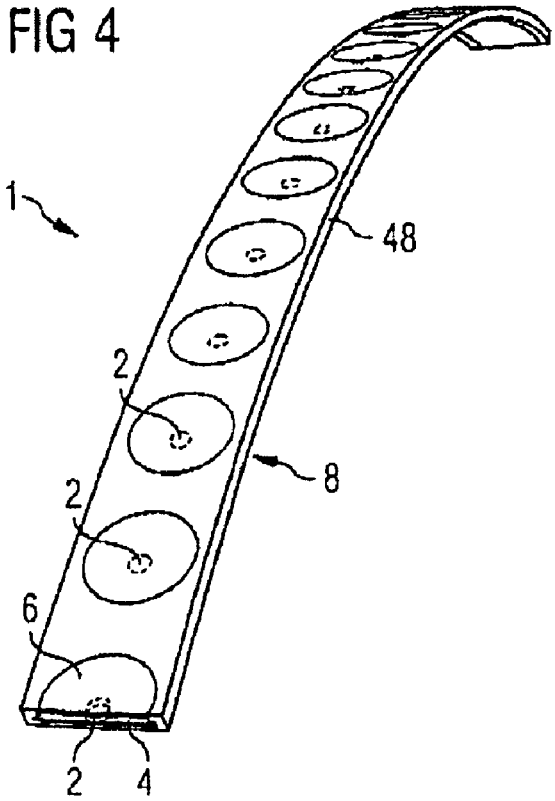
FIG. 4 is a schematic perspective representation of an illuminating system of flexible shape according to a third exemplary embodiment that employs COF technology.

FIG. 4 shows a third exemplary embodiment of an illuminating system 1 which again is configured so as to minimize its overall size. The overall height is preferably 3 mm or less, particularly preferably 2 mm or less, for example 1.5 mm. This exemplary embodiment differs from the previously described exemplary embodiment essentially by the fact that in this variant the LEDs 2 are mounted directly—i.e., without a housing—on the flexboard 4 (COF, Chip on Flexboard). Chip on flexboard technology is a production technology used in the microelectronics industry, in which the unhoused semiconductors, for example LED chips, are adhesively bonded directly to the circuit board 4 and are then electrically contacted by means of microwires. Alternatively, the LED chips can also be attached directly to the circuit board and electrically contacted by means of at least one contact. This can be done by soldering, for example.

Figure 5:
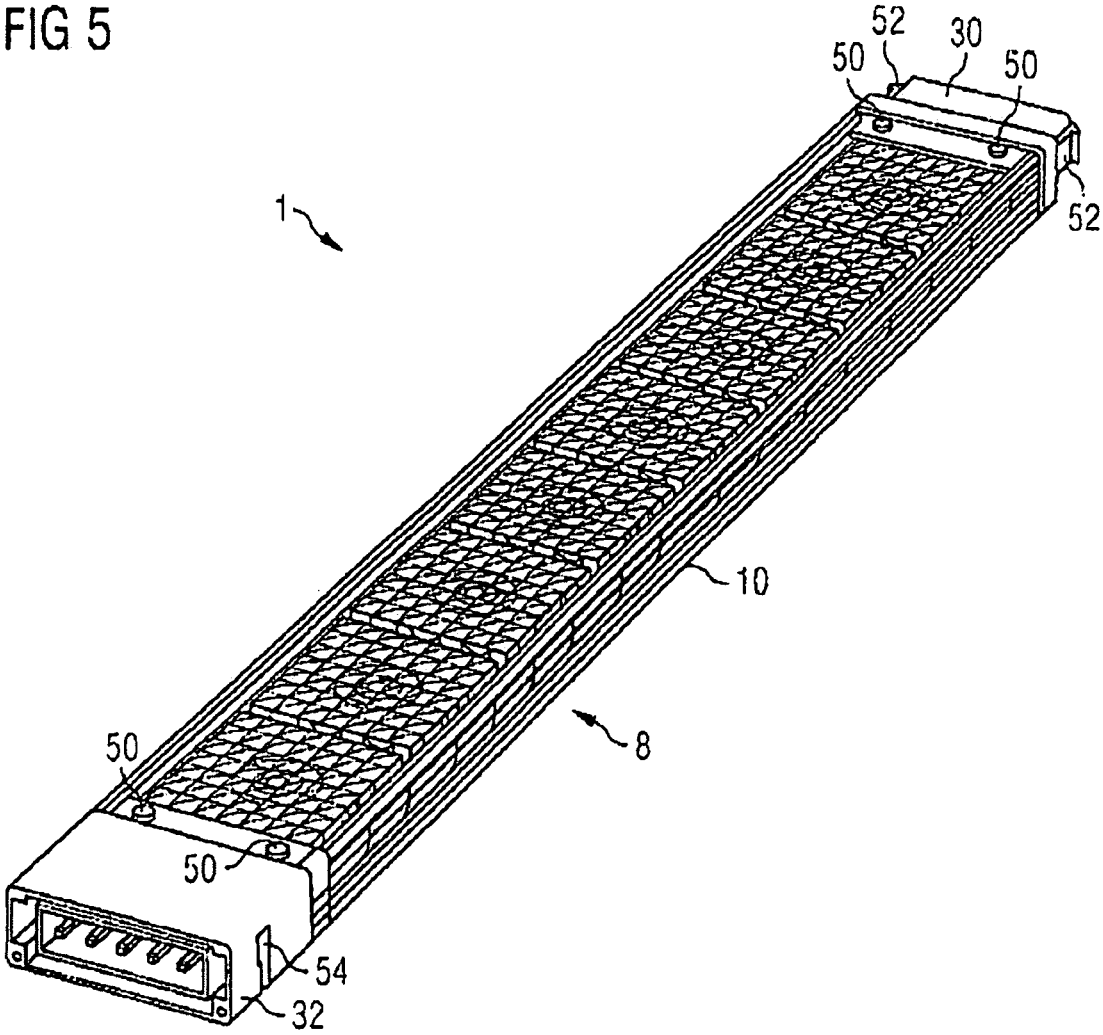
FIG. 5 is a schematic perspective representation of an illuminating system of flexible shape according to a fourth exemplary embodiment comprising a Fresnel lens.

In the fourth exemplary embodiment, depicted schematically in FIG. 5, a light bar 8 is shown in which a five-pin plug connector system 30, 32, consisting of a plug 30 and a socket 32, is inserted in the approximately rectangular hollow profile bar 10 at each end and is fixed in place by means of fasteners 50, for example rivets, screws or clip mechanisms. To fix them in the socket 32, the plugs 30 are provided with latching projections 52 that are insertable into and fixable in mating latching recesses 54 in the socket 32 of an adjacent light bar 8. A flexible light strip composed of multiple light bars 8 can thus be built up in a simple manner (Plug & Play), as dictated by the lighting situation.

Figure 6:
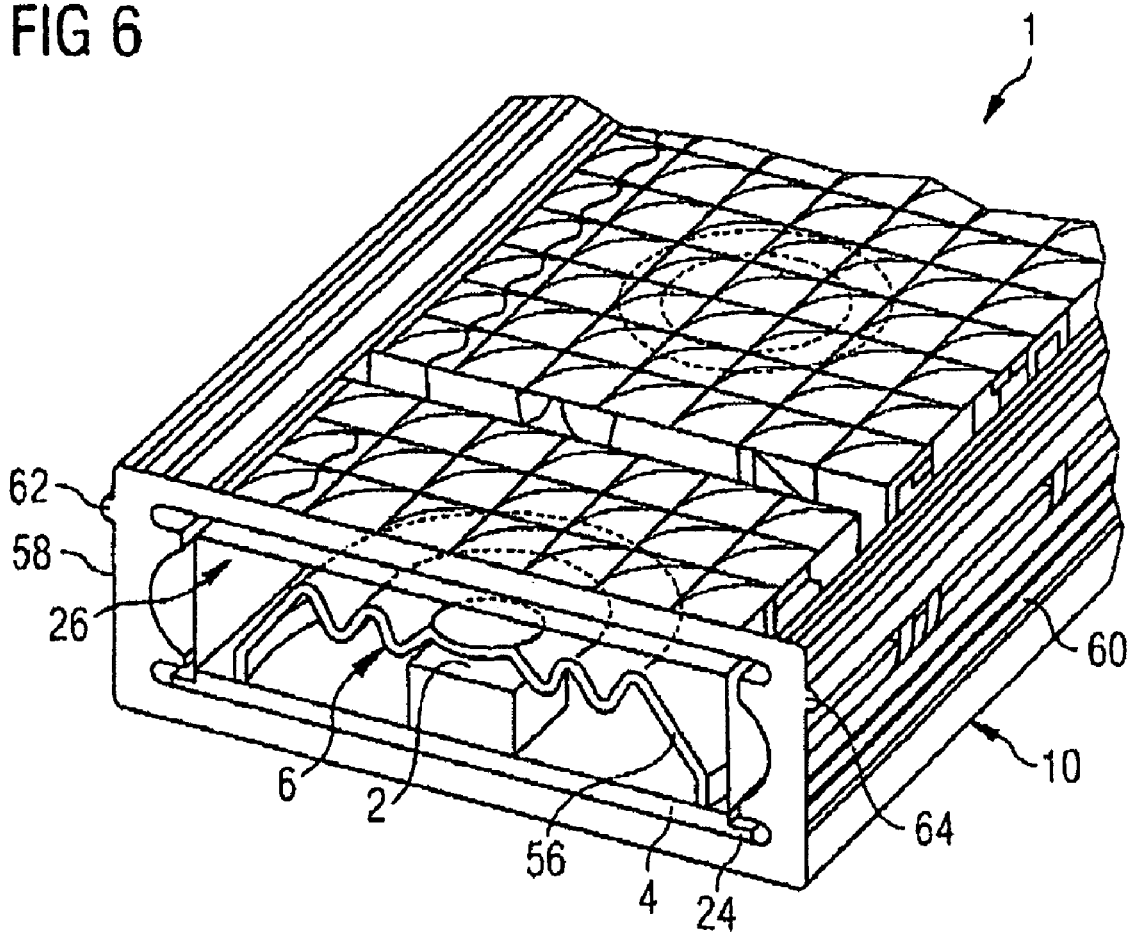
FIG. 6 is a schematic detail representation of the light bar according to the fourth exemplary embodiment (FIG. 5), without the connector system.

Turning now to FIG. 6, which is a detail representation of the light bar 8 from FIG. 5 without the plug connector system 30, 32, this fourth exemplary embodiment differs from that shown in FIG. 1 essentially in that the optic 6 associated with the LEDs 2 is configured as an essentially U-shaped, flexible Fresnel lens 56. This is supported by its narrow sides on the flexboard 4 and is fixed in the interior space 26 of the hollow profile bar 10. In the exemplary embodiment shown, a cooling plate 24 of high thermal conductivity is disposed under the flexboard 4 to dissipate the waste heat developed by the LEDs 2. Through this optimization of thermal management, the light output of the illuminating system 1 can be improved further without altering its reduced installation space. To mount the illuminating system 1, for example on a ceiling, the floor, the wall or a piece of furniture, the hollow profile bar 10 comprises, on lateral faces 58, 60, two projections 62, 64 that engage in respective guide channels 66, 68 of a mounting profile 70 (see FIG. 7), such that the hollow profile bar 10 is insertable form-lockingly into the mounting profile 70. In an alternative exemplary embodiment (not shown), the cooling plate 24 or the mounting surface is implemented as magnetic in order to mount the illuminating system 1 on magnetizable surfaces.

Figure 7:
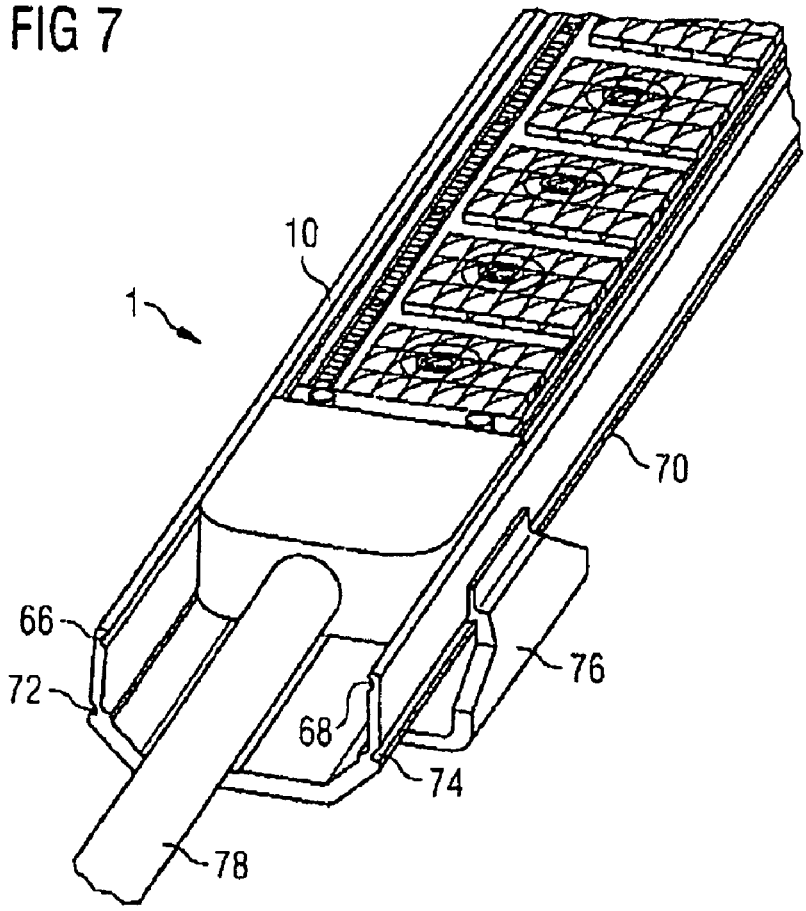
FIG. 7 is an illuminating system according to a fifth exemplary embodiment in the state of being inserted in a mounting profile, in schematic perspective representation.

According to FIG. 7, which shows an illuminating system 1 according to a fifth exemplary embodiment in the state of being inserted in the mounting profile 70, the mounting profile 70 is configured as essentially U-shaped and is provided on each of its narrow sides with a respective channel 72, 74, in which a roughly U-shaped, fixedly disposable holder 76 for mounting the illuminating system 1 form-lockingly engages. In the illuminating system 1 shown, the plug connector system is provided with a connecting cable 78.

Figure 8:
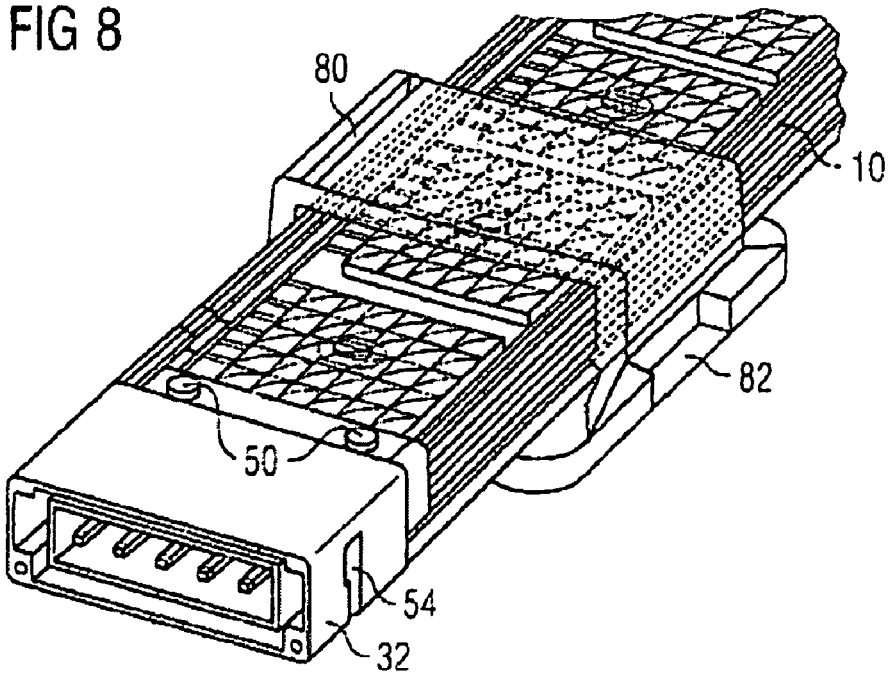
FIG. 8 is a schematic representation of an illuminating system according to a sixth exemplary embodiment, in which the hollow profile bar for mounting the illuminating system is mounted directly in a holding bracket.

FIG. 8 shows a sixth exemplary embodiment, in which the hollow profile bar 10 for mounting the illuminating system 1, for example on a ceiling, the floor, the wall or a piece of furniture, is fixed directly, i.e., without a mounting profile 70, and in a longitudinally slidable and flexibly bendable manner, in a holding bracket 82 provided with a shackle 80. A plurality of spaced-apart holding brackets 82 are preferably used to mount the illuminating system 1.

Figure 9:
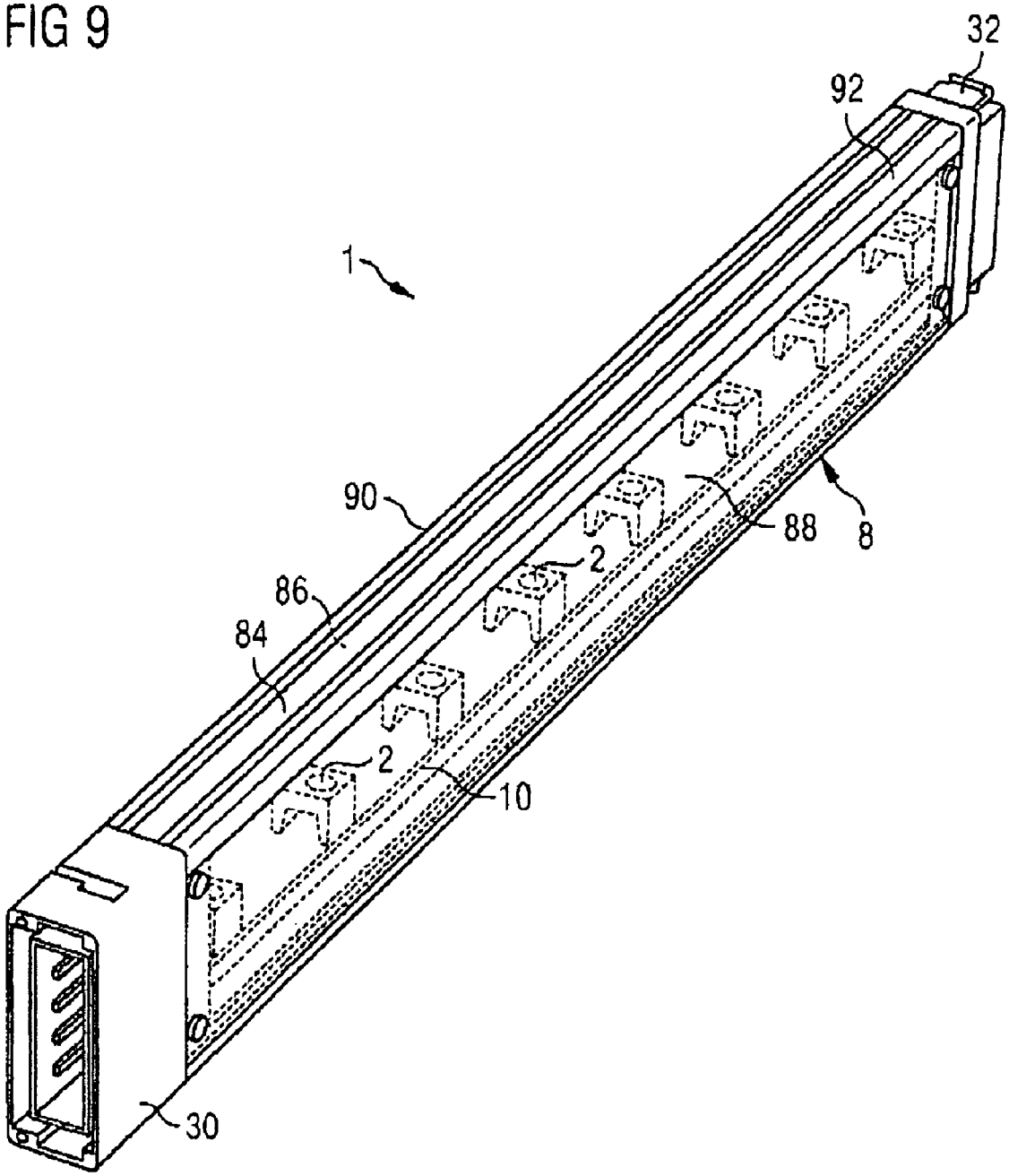
FIG. 9 shows an illuminating system according to a seventh exemplary embodiment, comprising LEDs that emit laterally in the direction of the narrow side of the illuminating system, in schematic representation.
Figure 10:
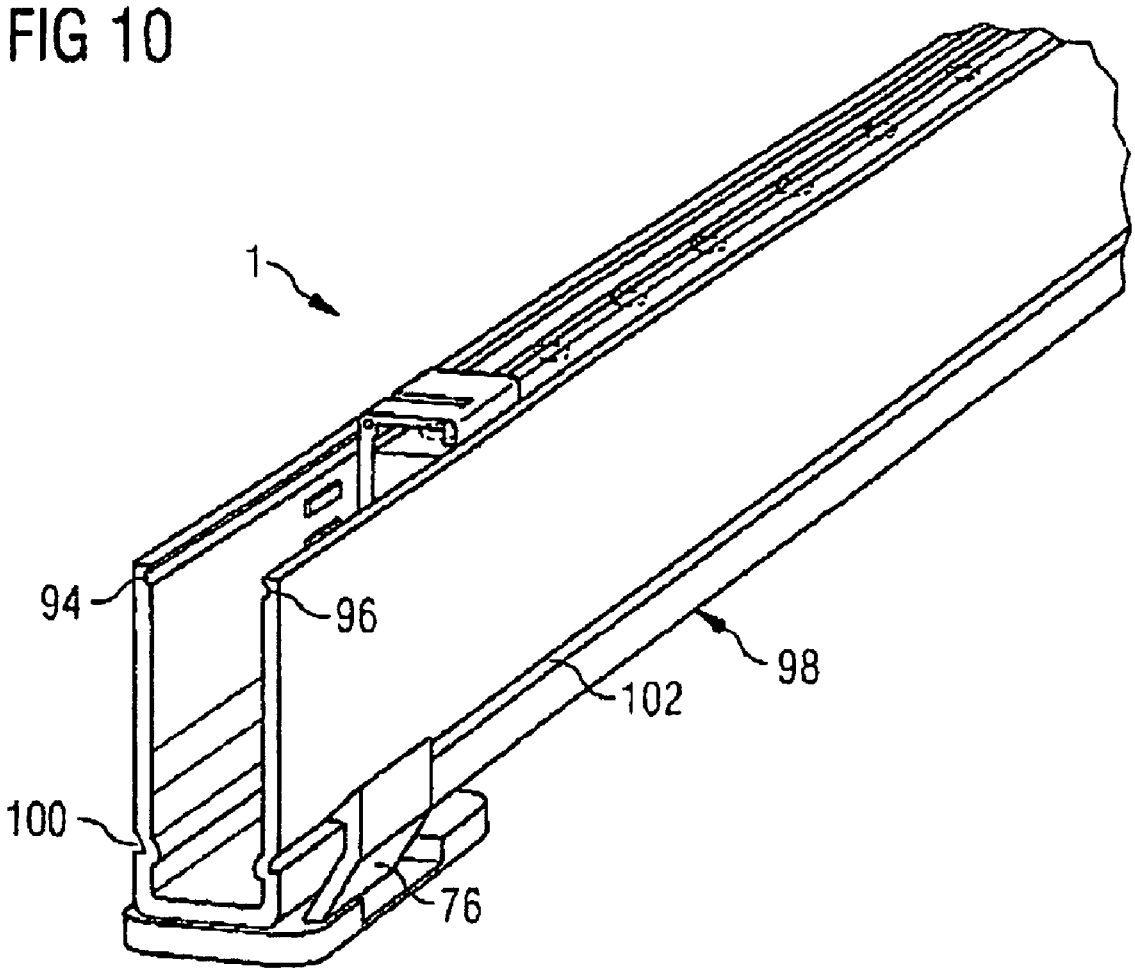
FIG. 10 shows the illuminating system according to the seventh exemplary embodiment (FIG. 9) in the state of being inserted in a mounting profile.

FIG. 9 shows a seventh exemplary embodiment of a light bar 8 employing SIDELED® type LEDs 2 that emit laterally, in the direction of a narrow side 84 of the illuminating system 1. Such light bars 8 need very little installation space and in order to mount the illuminating system 1, for example on a ceiling, the floor, the wall or a piece of furniture, are insertable form-lockingly into the mounting profile 98 via two projections 90, 92, which are provided on lateral faces 86, 88 of hollow profile bar 10 and which, as per FIG. 10, each engage in a respective guide channel 94, 96 of a mounting profile 98. The mounting profile 98 of essentially U-shaped cross section is provided on each of its broad sides with a respective channel 100, 102 in which an approximately U-shaped, fixedly disposable holder 76 for mounting the illuminating system 1 form-lockingly engages.

Figure 11:
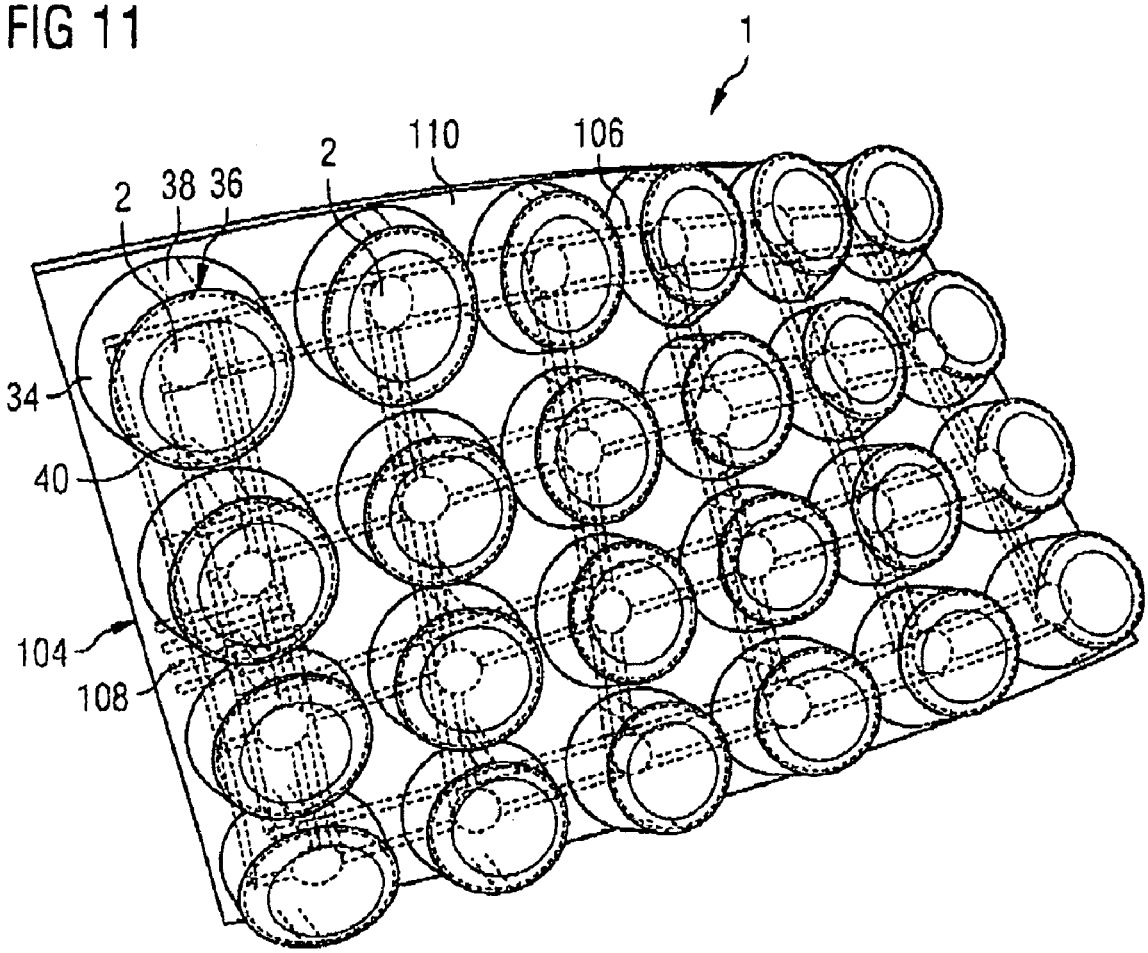
FIG. 11 is a schematic representation of an eighth exemplary embodiment of an illuminating system, configured as a flexible, pixel-type flat lamp equipped with a multiplicity of LEDs.

The flat and flexible implementation makes it possible to configure the illuminating system 1, according to an eighth exemplary embodiment (FIG. 11), as a flexible, pixel-type flat lamp 104 comprising a multiplicity of LEDs 2. The flat lamp 104 notably can be configured as a display, for example for moving images, or as a flat lamp 104 for a spherically curved lamp or a roof liner in automotive technology. In this eighth exemplary embodiment, the LEDs 2 are disposed matrix-like on a highly flexible film conductor 106 and are electrically contacted by means of conductive traces 108. The LEDs 2 are preferably controllable individually via a control device (not shown), particularly a bus, making it possible to obtain varied light effects, for example colors of light, accents, light dynamics or optical displays. It is generally advantageous in this case if the LEDs 2 are configured as colored and/or color-changing. For example, the LEDs can comprise diverse LED chips that emit radiation in mutually different regions of the spectrum. Using LEDs with which the intensity of the emitted radiation in the red, green and blue spectral regions can be adjusted separately, a full-color, active display device can be configured in a simplified manner. Further, the illuminating system 1 can be equipped with a combination of different LEDs 2. The optic 6 is formed by a rigid lens optic 34 made of glass, configured as a separate component and placed in front of each LED 2, such that the illuminating system 1 can be variably adapted to different lighting and illumination tasks by changing the optics 34. The flexibility is provided in this case by the fact that the lenses 32 are supported on the film conductor 106 by respective holders 36 each composed of two diametrically oppositely disposed support elements 38, 40 and are fixed, knob-like, on the film conductor 106 by means of a film 110 that form-lockingly surrounds them, the holder 36 and the film conductor 106 being so configured as not to present an obstacle to deformation of the illuminating system 1. The illuminating system 1 can be freely oriented and focused by varying the curvature. The film 110 and the film conductor 106 serve to protect the LEDs 2 against environmental influences (water, dust, radiation, chemicals, and to some extent also the action of external forces) (Protection Class IP65). Such a flat lamp 104 or flat display is suitable for placement on curved surfaces having potentially multiple, mutually parallel or obliquely convergent axes of curvature with different, potentially negative, bending radii. The flat lamp 104 can be cut into individual rectangles and the electrical connections re-established by means of a connecting element (not shown), for example an X connector. The individual lenses 34 can also be connected to one another quasi-elastically, for example via a web or an expanded metal mesh. In this way, the lens system can also be used in an LED array in which the pitch of the LEDs varies.

The illuminating system 1 is not limited to the exemplary embodiments shown; rather, the illuminating system 1 can be given a variety of forms. As noted at the outset, the described light bars 8 and flat lamps 104 can be varied and combined in any desired manner, by virtue of the flexible shape and modular nature of the illuminating system 1.

Disclosed is an illuminating system 1 of flexible shape comprising at least one LED 2 disposed on a flexible carrier material 4, an optic 6 being provided that permits uniform, directed and/or glare-free light emission.

The invention is not limited by the description made with reference to the exemplary embodiments. Rather, the invention encompasses any novel feature and any combination of features contained in the claims, even if that feature or combination itself is not explicitly mentioned in the claims or exemplary embodiments.

The invention claimed is:

1. An illuminating system of flexible shape and comprising at least one LED disposed on a flexible carrier material, and an optic that permits uniform, directed and/or glare-free light emission;

wherein said carrier material with said at least one LED and said optic is received in at least one flexible hollow profile bar of substantially rectangular cross section, in which said LEDs are adjacently disposed and form a common light-emitting area;

wherein in order to mount the illuminating system, said hollow profile bar is insertable form-lockingly into a mounting profile;

wherein said hollow profile bar comprises at least one projection that engages in at least one guide channel of said mounting profile, or said hollow profile bar comprises at least one guide channel in which at least one projection of said mounting profile engages;

wherein the side walls of said mounting profile each comprise at least one channel in which an approximately U-shaped, fixedly disposable holder form-lockingly engages.

2. The illuminating system of flexible shape as in claim 1, wherein said optic is a Fresnel lens.

3. The illuminating system of flexible shape as in claim 1, wherein said optic is configured as a separate component.

4. The illuminating system of flexible shape as in claim 1, wherein said optic is configured by means of a nano- and/or microstructured film.

5. The illuminating system of flexible shape as in claim 1, wherein said optic comprises a macrostructure.

6. The illuminating system of flexible shape as in claim 1, wherein said optic comprises convexities, corrugations, or knobs.

7. The illuminating system of flexible shape as in claim 1, wherein said optic comprises an optically active fluid.

8. The illuminating system of flexible shape as in claim 1, wherein said optic is made of rigid material.

9. The illuminating system of flexible shape as in claim 1, wherein said optic is made of glass.

10. The illuminating system of flexible shape as in claim 1, wherein said optic is held in place via a holder in such a way that it does not hinder deformation of said illuminating system.

11. The illuminating system of flexible shape as in claim 10, wherein said holder comprises at least two support elements, which are disposed diametrically opposite each other, and is supported by them on said carrier material.

12. The illuminating system of flexible shape as in claim 1, wherein said optic is mounted in such a way that its position in relation to said LED remains substantially unchanged during deformation of said illuminating system.

13. The illuminating system of flexible shape as in claim 1, wherein said illuminating system comprises flat LEDs.

14. The illuminating system of flexible shape as in claim 1, wherein said illuminating system comprises DRAGON®, TOPLED®, POINTLED® and/or SIDELED® type flat LEDs.

15. The illuminating system of flexible shape as in claim 1, wherein said LEDs are configured as colored and/or color-changing.

16. The illuminating system of flexible shape as in claim 1, wherein a flexboard and/or a film conductor is used as said carrier material.

17. The illuminating system of flexible shape as in claim 1, wherein said LED is placed, unhoused, directly on said carrier material.

18. The illuminating system of flexible shape as in claim 1, wherein said illuminating system comprises additional height-optimized components.

19. The illuminating system of flexible shape as in claim 1, wherein at least one thin cooling element of high thermal conductivity is provided to dissipate heat from said LEDs.

20. The illuminating system of flexible shape as in claim 19, wherein said cooling element is implemented as a cooling plate.

21. The illuminating system of flexible shape as in claim 1, wherein said carrier material with said at least one LED and said optic is received in at least one flexible lamp envelope.

22. The illuminating system of flexible shape as in claim 21, wherein said flexible lamp envelope is formed by at least one element from the group consisting of molded part, tube, film and deep-drawn film.

23. The illuminating system of flexible shape as in claim 1, wherein said hollow profile bar is of a flexible plastic.

24. The illuminating system of flexible shape as in claim 23, wherein said hollow profile bar is of PMMA.

25. The illuminating system of flexible shape as in claim 1, wherein said hollow profile bar is closed endwise by an end piece and/or by a plug-type electrical connector system.

26. The illuminating system of flexible shape as in claim 25, wherein said end piece and/or said plug connector system are configured in such a way that in the state of being mounted on said hollow profile bar, at least one of their lateral faces extends approximately flush with at least one lateral face of said hollow profile bar.

27. The illuminating system of flexible shape as in claim 1, wherein said illuminating system is configured as a flat, pixel-type flat lamp comprising a multiplicity of LEDs.

28. The illuminating system of flexible shape as in claim 27, wherein said flat, pixel-like flat lamp is a display.

29. The illuminating system of flexible shape as in claim 1, wherein said LEDs are controllable individually via a control device.

30. The illuminating system of flexible shape as claim 1, wherein said LEDs are controllable individually via a bus.

31. The illuminating system of flexible shape as in claim 1, wherein an overall height of said illuminating system is 5 mm or less.

32. The illuminating system of flexible shape as in claim 1, wherein an overall height of said illuminating system is 3 mm or less.

* * * * *